US010595653B1

(12) United States Patent
Messilaty et al.

(10) Patent No.: US 10,595,653 B1
(45) Date of Patent: Mar. 24, 2020

(54) BEVERAGE SYSTEM

(71) Applicants: Shalom Messilaty, Hewlett, NY (US); Sami Edalati, Roslyn Heights, NY (US)

(72) Inventors: Shalom Messilaty, Hewlett, NY (US); Sami Edalati, Roslyn Heights, NY (US)

( * ) Notice: Subject to any disclaimer, the term of this patent is extended or adjusted under 35 U.S.C. 154(b) by 0 days.

(21) Appl. No.: 16/388,996

(22) Filed: Apr. 19, 2019

(51) Int. Cl.

| | |
|---|---|
| ***A47G 19/22*** | (2006.01) |
| ***B65D 45/02*** | (2006.01) |
| ***B65D 51/20*** | (2006.01) |
| ***B65D 65/02*** | (2006.01) |
| ***B65D 51/28*** | (2006.01) |

(52) U.S. Cl.
CPC ..... *A47G 19/2255* (2013.01); *B65D 45/02* (2013.01); *B65D 51/20* (2013.01); *B65D 51/2807* (2013.01); *B65D 65/02* (2013.01); *B65D 2275/00* (2013.01); *B65D 2543/00046* (2013.01)

(58) Field of Classification Search
USPC ..... 220/315–326, 737–740; 215/273–292; 224/148.1–148.7
See application file for complete search history.

(56) References Cited

U.S. PATENT DOCUMENTS 1,513,581 A * 10/1924 Caumont ..... A47J 36/10 222/108
2,772,014 A * 11/1956 Clark ..... B65D 55/063 215/250
3,893,725 A * 7/1975 Coulter ..... B65D 45/02 292/258
4,976,371 A * 12/1990 Wise ..... B65D 45/02 220/315
5,048,734 A * 9/1991 Long ..... A45C 11/20 150/901
5,320,249 A * 6/1994 Strech ..... B65D 81/3876 220/739
5,325,991 A * 7/1994 Williams ..... A45F 5/02 215/12.1
D415,390 S * 10/1999 Winnington-Ingram ..... D3/202
5,976,014 A * 11/1999 Petrick ..... B42D 5/023 281/2
D583,629 S * 12/2008 Sgrillo ..... D7/607
10,064,507 B1 * 9/2018 Shih ..... B65D 51/18
(Continued)

*Primary Examiner* — James N Smalley
(74) *Attorney, Agent, or Firm* — Sorell, Lenna & Schmidt, LLP

(57) ABSTRACT

A beverage system is provided that includes a cup having a frustoconical wall extending from a first end to a second end. The first end is coupled to a bottom wall and the second end defines a rim. Inner surfaces of the walls define a cavity. The rim defines an opening that is in communication with the cavity. A lid is coupled to the rim such that the lid covers at least a portion of the opening. A sleeve includes a collar that surrounds a portion of the frustoconical wall. The sleeve includes first and second arms. The arms each include a first end coupled to the collar and an opposite second end. The second end of the first arm directly engages the lid. The second end of the second arm directly engages the second end of the first arm when the second end of the first arm directly engages the lid to prevent the lid from being removed from the cup.

20 Claims, 12 Drawing Sheets

(56) References Cited

U.S. PATENT DOCUMENTS

| | | | | |
|---|---|---|---|---|
| 2007/0257049 | A1* | 11/2007 | Tolan | A47G 23/0216<br>220/737 |
| 2008/0230545 | A1* | 9/2008 | Weene | B65D 25/20<br>220/375 |
| 2009/0276982 | A1* | 11/2009 | Nossa | A47G 23/0233<br>24/305 |
| 2010/0072234 | A1* | 3/2010 | Tymczyna | A45C 3/001<br>224/148.6 |

* cited by examiner

BEVERAGE SYSTEM

TECHNICAL FIELD

The present disclosure generally relates to beverages, and more particularly to a beverage system including a device for preventing beverages from spilling from a container.

BACKGROUND

Hot beverages, cold beverages as well as soups are frequently purchased as take out items. For example, coffee, tea, iced coffee, and sodas are frequently served in disposable paper or plastic cups so that they can be taken with a consumer along his or her travels. While some cups are provided with a lid to cover the cup, such lids tend to become dislodged from the cup. Some cups also have drinking ports that leak or slits in the lid to receive straws that also leak thus creating the potential for spilling the hot or cold beverage from the cup.

In addition, iced beverages, such as iced coffee and soda often cause beads of water to form on the outside of the cup as the ice inside the cup melts. The customer carrying the cup, unless protected, ends up with wet hands, which is uncomfortable and messy for the customer, especially if they are dressed in a suit or dress on their way to work.

Some beverage cups, usually hot beverage cups, are provided with a sleeve that surrounds a portion of the cup to provide a barrier between the cup and the consumer's hand to protect the consumer's hand from the heat created by the hot beverage. Some hot beverage cup sleeves are insulated to better protect the user's hand from heat. Furthermore, some hot beverage cup sleeves include handles to facilitate carrying the cup without the consumer's hand grasping the cup or the sleeve.

However, the problem of leaking from the lid of a cup or the lid coming dislodged from the cup causing a spill still exists. In addition. the problem of protecting the user's hands from the sweat formed on the outside of the cup as ice melts in iced coffee or soda also still exists. This disclosure describes an improvement over these prior art technologies that directly deal with both these problems.

SUMMARY

In one embodiment, in accordance with the principles of the present disclosure, a beverage system is provided that includes a cup having a frustoconical wall extending from a first end to a second end. The first end is coupled to a bottom wall and the second end defines a rim. Inner surfaces of the walls define a cavity. The rim defines an opening that is in communication with the cavity. A lid is coupled to the rim such that the lid covers at least a portion of the opening. A sleeve includes a collar that surrounds a portion of the frustoconical wall. The sleeve includes first and second arms. The arms each include a first end coupled to the collar and an opposite second end. The second end of the first arm directly engages the lid. The second end of the second arm directly engages the second end of the first arm when the second end of the first arm directly engages the lid to prevent the lid from being removed from the cup.

In some embodiments, the beverage system described in the preceding paragraph is provided in an unassembled state. The lid is coupled to the rim. The cup is positioned in the collar with the second end of the first arm spaced apart from the lid and the second end of the second arm. The collar is translated relative to the cup such that the collar forms a friction fit with the frustoconical wall. The second end of the first arm is coupled to the lid. The second end of the second arm is coupled to the second end of the first arm.

In one embodiment, in accordance with the principles of the present disclosure, a beverage system includes a cup comprising a frustoconical wall extending from a first end to a second end. The first end is coupled to a bottom wall and the second end defines a rim. Inner surfaces of the walls define a cavity. The rim defines an opening that is in communication with the cavity. A lid is coupled to the rim such that the lid covers at least a portion of the opening. A cap comprises a body having a peripheral edge. The body defines a cavity having the lid and a portion of the cup disposed therein. The peripheral edge comprises an elastic material and engages an outer surface of the frustoconical wall to secure the cap to the cup such that the lid and a portion of the cup are enclosed within the cavity.

In some embodiments, the beverage system described in the preceding paragraph is provided in an unassembled state. The lid is coupled to the rim. The body is moved from an unexpanded orientation to an expanded orientation. The cup is positioned in the cavity with the body in the expanded orientation. The body is moved from the expanded orientation to unexpanded orientation such that the elastic material engages the outer surface to secure the cap to the cup such that the lid and a portion of the cup are enclosed within the cavity.

In one embodiment, in accordance with the principles of the present disclosure, a beverage system includes a cup comprising a non-insulated material and a frustoconical wall extending from a first end to a second end. The first end is coupled to a bottom wall and the second end defines a rim. Inner surfaces of the walls define a cavity. The rim defines an opening that is in communication with the cavity. A lid is coupled to the rim such that the lid covers at least a portion of the opening. A sleeve comprises a collar that surrounds a portion of the frustoconical wall. The collar comprises a first end that is permanently joined with a second of the collar to define a loop. The collar has a height defined by a distance between a top end of the collar and an opposite bottom end of the collar. The collar is tapered such that the top end has a diameter that is greater than a diameter of the bottom end. The sleeve comprises first and second arms. The arms are monolithically formed with the collar. The first arm has a maximum length that is equal to a maximum length of the second arm. The arms each include a first end coupled to the collar and an opposite second end. The first arm has a uniform thickness from the first end of the first arm to the second end of the first arm. The second arm has a uniform thickness from the first end of the second arm to the second end of the second arm. The second end of the first arm directly engages the lid. The second end of the second arm directly engages the second end of the first arm when the second end of the first arm directly engages the lid to prevent the lid from being removed from the cup. An adhesive is positioned between the second end of the second arm and the second end of the first arm to secure the second end of the second arm to the second end of the first arm.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

The present disclosure may be understood more readily by reference to the following detailed description of the disclosure taken in connection with the accompanying drawing figures, which form a part of this disclosure. It is to be understood that this disclosure is not limited to the specific devices, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" or "top" and "bottom" are relative and used only in the context to the other, and are not necessarily "superior" and "inferior".

The following discussion includes a description of a beverage system that includes a device for preventing beverages from spilling from a container, shielding the user's hand from sweat formed on the outside of a cup with cold beverages, that keeps the lid closed on the cup in accordance with the principles of the present disclosure. Alternate embodiments are also disclosed. Reference will now be made in detail to the exemplary embodiments of the present disclosure, which are illustrated in the accompanying figures. Turning to FIGS. 1-21, there are illustrated a beverage system 20.

Figure 2:
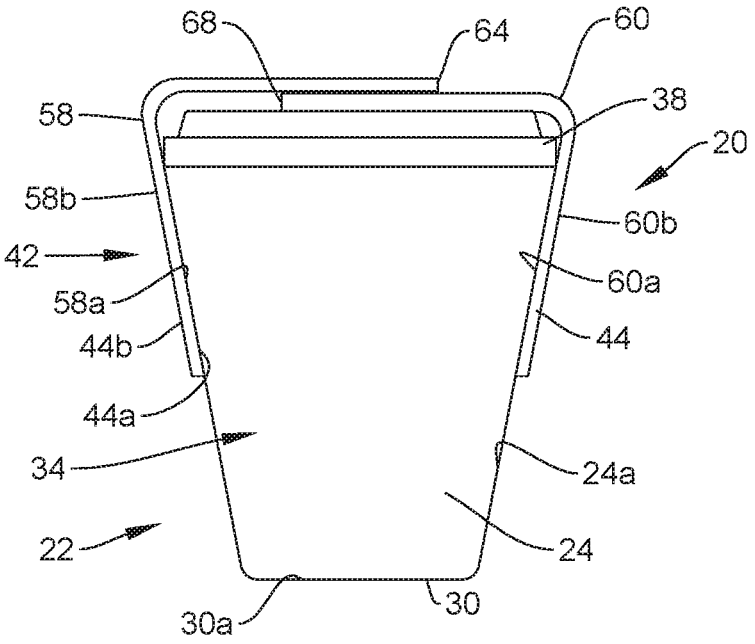
FIG. 2 is a side, cross-sectional view of components of the retaining system shown in FIG. 1.
Figure 3:
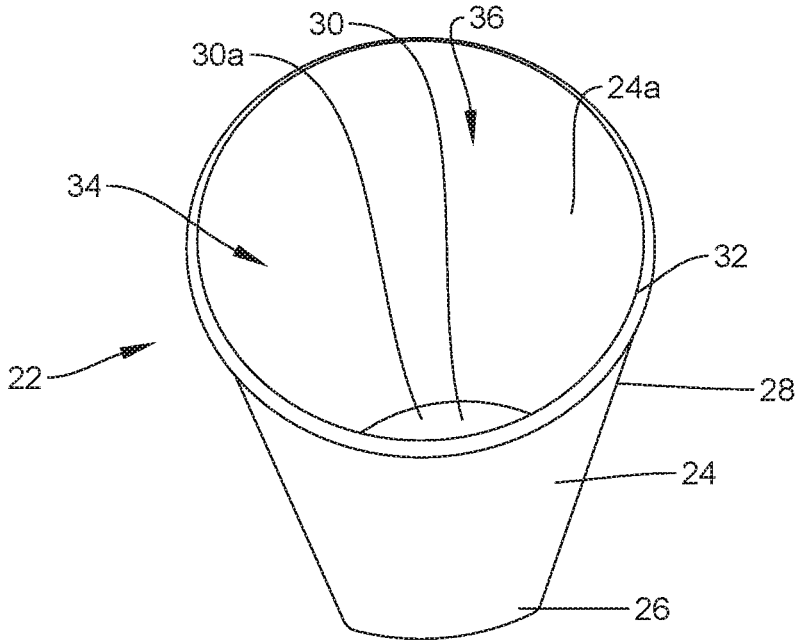
FIG. 3 is a perspective view of a component of the beverage system shown in FIG. 1.
Figure 4:
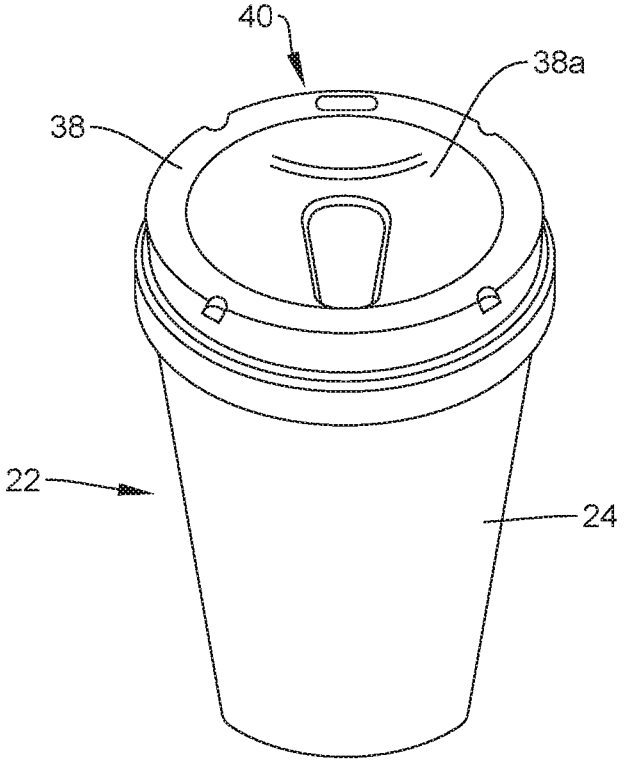
FIG. 4 is a perspective view of components of the beverage system shown in FIG. 1.

System 20 includes a cup 22 comprising and a frustoconical wall 24 extending from a first end 26 to a second end 26. End 26 is coupled to a bottom wall 28 and end 26 defines a rim 30. An inner surface 24*a* of wall 24 and an inner surface 30*a* of wall define a cavity 34 configured for disposal of a liquid, such as, for example, a hot beverage. Rim 32 defines an opening 36 that is in communication with cavity 34. In some embodiments, wall 24 is tapered from end 28 to end 26. That is, end 28 has a maximum diameter D1 that is greater than a minimum diameter D2 of end 26, as shown in FIG. 2. Wall 24 is continuously tapered from diameter D1 to diameter D2. In some embodiments, opening 36 may have various cross section configurations, such as, for example, circular, oval, oblong, triangular, rectangular, square, polygonal, irregular, uniform, non-uniform, variable and/or tapered.

In some embodiments, cup 22 is disposable. In some embodiments, cup 22 is reusable. In some embodiments, all or a portion of cup 22 is made from a non-insulated and/or non-thermal material. In some embodiments, wall 24 and/or wall 30 are made from an insulating and/or thermal material. In some embodiments, all or a portion of cup 22 is made from a material selected from the group consisting of paper, cardboard, Styrofoam, plastic (e.g., polystyrene, polypropylene, polyethylene terephthalate), foamed plastic, unfoamed plastic, steel, stainless steel, aluminum, ceramic, glass (e.g., Pyrex), or a combination thereof. In some embodiments, all or a portion of cup 22 is made from a non-waterproof material and surface 24*a* and/or surface 30 is/are provided with a waterproof coating, such as, for example, plastic polyethylene and/or wax. In some embodiments, all or a portion of cup 22 is made from a non-waterproof material and surface 24*a* and/or surface 30 is/are provided with a waterproof lining, such as, for example, plastic and/or wax. In some embodiments, all or a portion of cup 22 is made from a material that is free of bisphenol A (BPA) and bisphenol S (BPS). In some embodiments, all or a portion of cup 22 is made from a single layer of material. In some embodiments, all or a portion of cup 22 is made from two layers of material, wherein the two layers are separated by a vacuum.

System 20 includes a lid 38 coupled to rim 32 such that lid 38 covers at least a portion of opening 36. Lid 40 comprises an aperture 40 that is communication with opening 36 and cavity 34 to allow liquid in cavity 34 to exit cup 22 through opening 36 and aperture 40. In some embodiments, aperture 40 is permanently open. That is, aperture 40 is not capable of being closed. In some embodiments, aperture 40 may have various cross section configurations, such as, for example, circular, oval, oblong, triangular, rectangular, square, polygonal, irregular, uniform, non-uniform, variable and/or tapered.

In some embodiments, lid 38 is configured to be snap fit onto rim 32. In some embodiments, lid 38 is disposable. In some embodiments, lid 38 is reusable. In some embodiments, a layer of material, such as, silicone or rubber, for example, is positioned between an inner surface of lid 38 and an outer surface of rim 32 that forms a waterproof seal between lid 38 and rim 32. In some embodiments, lid 38 is made from a material selected from the group consisting of paper, cardboard, Styrofoam, plastic (e.g., polystyrene, polypropylene, polyethylene terephthalate), foamed plastic, unfoamed plastic, steel, stainless steel, aluminum, ceramic, glass (e.g., Pyrex), silicone, and combinations thereof.

Figure 5:
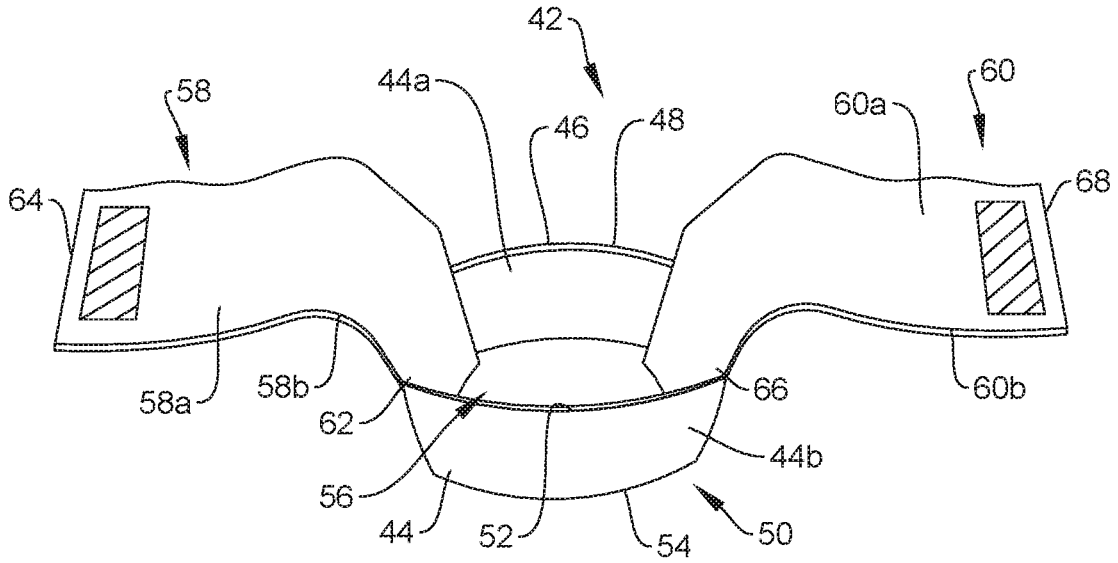
FIG. 5 is a perspective view of a component of the beverage system shown in FIG. 1.
Figure 6:
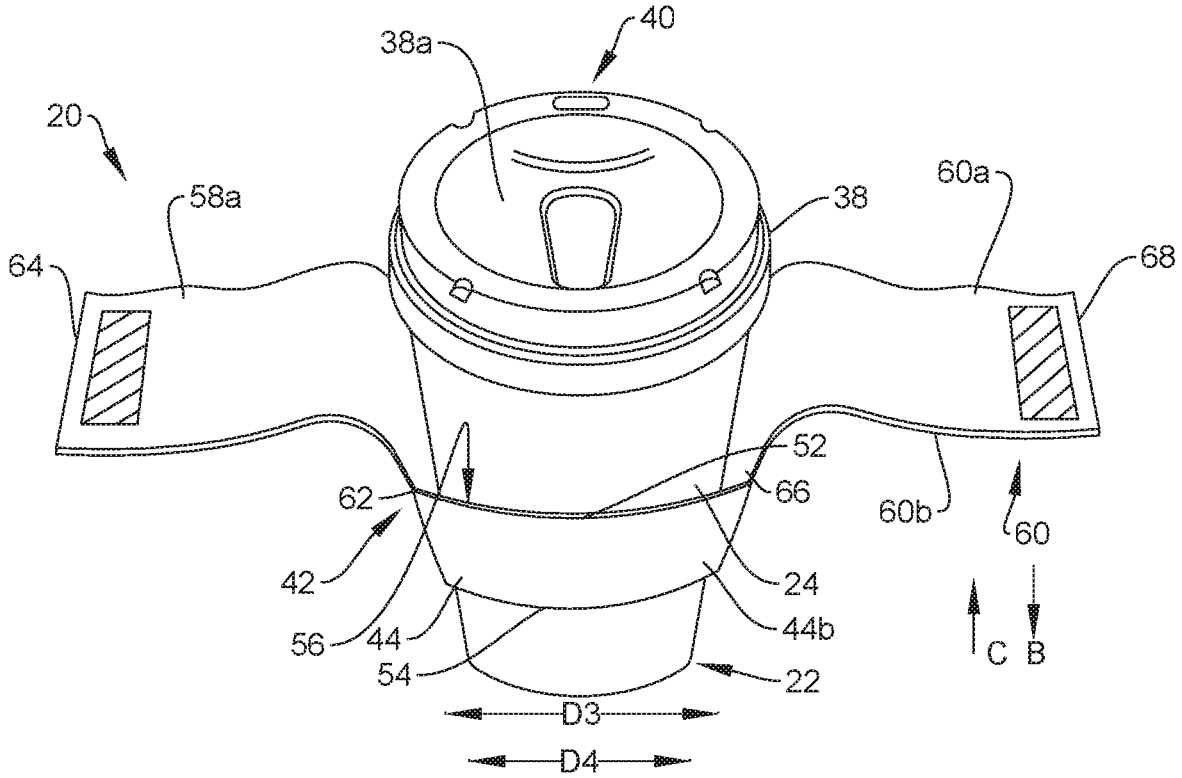
FIG. 6 is a perspective view of components of the beverage system shown in FIG. 1.
Figure 7:
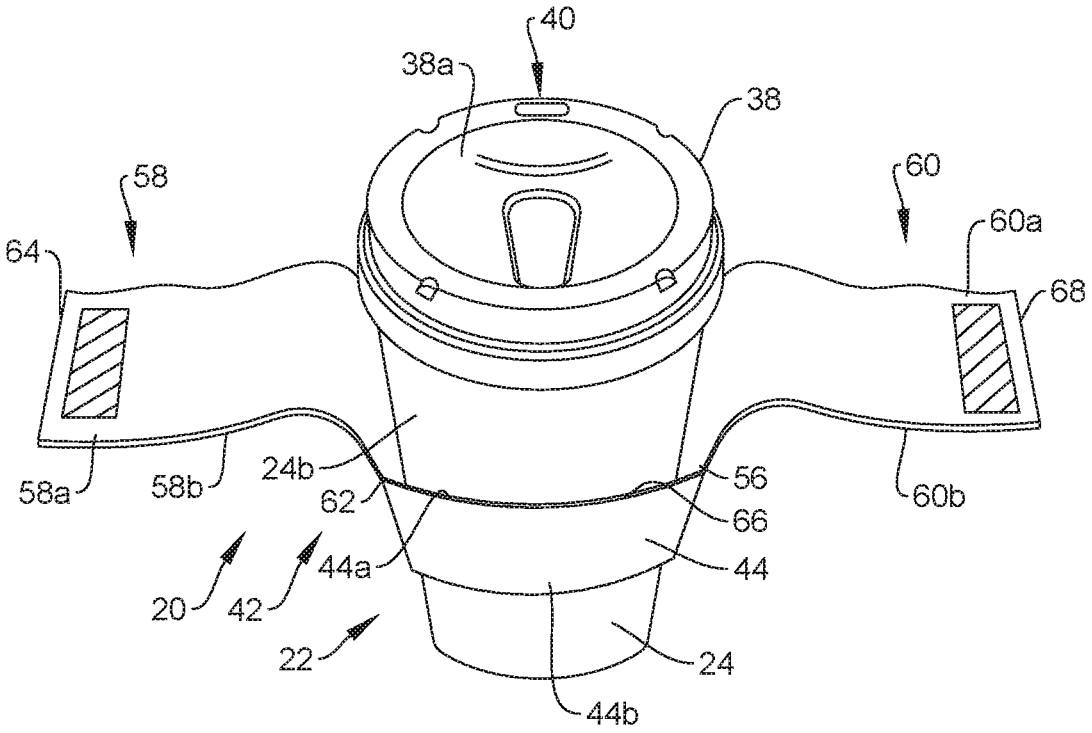
FIG. 7 is a perspective view of components of the beverage system shown in FIG. 1.

System 20 includes a sleeve 42 comprising a collar 44 that surrounds a portion of wall 24. Collar 44 comprises a first end 46 that is permanently joined with a second end 48 of collar 44 to define a continuous loop 50, as best shown in FIG. 5. That is, loop 50 is free of any gaps or recesses from end 46 to end 48 and/or between end 46 and end 48. In some embodiments, an outer surface of loop 50 is continuous about an entire outer perimeter of loop 50 such that there are no gaps or recesses in the outer surface of loop. In some embodiments, an inner surface of loop 50 is continuous about an entire inner perimeter of loop 50 such that there are no gaps or recesses in the inner surface of loop. Collar 44 has a height defined by a distance between a top end 52 of collar 44 and an opposite bottom end 54 of collar 44. Collar 44 is tapered such that end 52 has a diameter D3 that is greater than a diameter D4 of end 54, as best shown in FIG. 6. An inner surface 44*a* of collar 44 defines an orifice 56 configured for disposal of cup 22, as discussed herein. In particular, diameter D2 is less than diameter D3 such that end 24 of cup 22 can be inserted into orifice 56 by translating cup 22 relative to collar 44 in the direction shown by arrow B in FIG. 6 through end 52, as shown in FIG. 6. Cup 22 is then translated relative to collar 44 in the direction shown by arrow C in FIG. 6 such that surface 44*a* directly engages an outer surface 24*b* of wall 24, as shown in FIG. 7 to fix collar 44 relative to wall 24. In some embodiments, collar 44 forms a friction fit with wall 24 as surface 44*a* engages surface 24*b*. Diameter D4 is less than diameter D1, such that collar 44 is prevented from translating relative to cup 22 in the direction shown by arrow C in FIG. 6 until collar 44 engages rim 52. Due to the relative diameters of cup 22 and sleeve 42, collar 44 is fixed at a position between rim 32 and wall 30 when surface 44*a* engages surface 24*b*, as shown in FIG. 7. That is, because diameter D3 is less than diameter D1, collar 44 cannot be moved in the direction shown by arrow C in FIG. 6 past the position of collar in FIG. 7.

Sleeve 42 comprises an arm 58 extending from end 52 and an arm 60 extending from end 52. In some embodiments, arm 58 has an inner surface 58*a* that directly engages an outer surface 44*b* of collar 44 to couple arm 58 to collar 44 and arm 60 has an inner surface 60*a* that directly engages surface 44*b* to couple arm 60 to collar 44. In some embodiments, arm 58 has an outer surface 58*b* that directly engages surface 44*a* of collar 44 to couple arm 58 to collar 44 and arm 60 has an outer surface 60*b* that directly engages surface 44*a* to couple arm 60 to collar 44. In some embodiments, arms 58, 60 are integrally and/or monolithically formed with collar 44. In some embodiments, surface 58*a* is continuous with surface 44*a* and surface 60*a* is continuous with surface 44*a* such that there are no gaps or recesses between surface 58*a* and surface 44*a* or between surface 60*a* and surface 44*a*. In some embodiments, surface 58*b* is continuous with surface 44*b* and surface 60*b* is continuous with surface 44*b* such that there are no gaps or recesses between surface 58*b* and surface 44*b* or between surface 60*b* and surface 44*b*. In some embodiments, surface 44*b* is smooth and/or even and is free of any gaps and/or protrusions. In some embodiments, surface 44*b* is textured with grooves, for example, to enhance gripping of collar 44 by hand.

In some embodiments, collar 44 comprises a rigid material and arms 58, 60 are each made from a flexible material to allow arms 58, 60 to bend for attachment with lid 38 and/or another one of arms 58, 60, as discussed herein. For example, in one embodiment, collar 44 is made from a rigid material to provide collar 44 with a fixed diameter such that collar 44 is prevented from expanding or contracting radially and arms 58, 60 are attached to collar 44 such that arms 58, 60 can bend for positioning on adjacent to lid 38 or another one of arms 58, 60. In some embodiments, collar 44 and arms 58, 60 are made from an insulating and/or thermal material, such as, for example, corrugated cardboard. In some embodiments, collar 44 is made from an insulating and/or thermal material and arms 58, 60 are made from a non-insulated and/or non-thermal material. In some embodiments, collar 44 and arms 58, 60 are made from a non-insulated and/or non-thermal material.

Arm 58 has a maximum length defined by the distance from an end 62 of arm 58 to an opposite end 64 of arm and arm 60 has a maximum length defined by the distance from an end 66 of arm 60 to an opposite end 68 of arm 60. In some embodiments, the maximum length of arm 58 is equal to the maximum length of arm 60. Ends 62, 66 are each coupled collar 44. In some embodiments, arm 58 has a uniform thickness along the entire length of arm 58 and arm 60 has a uniform thickness along the entire length of arm 60. That is, arms 58, 60 are free of any indents, such as, for example, preformed fold lines.

Figure 1:
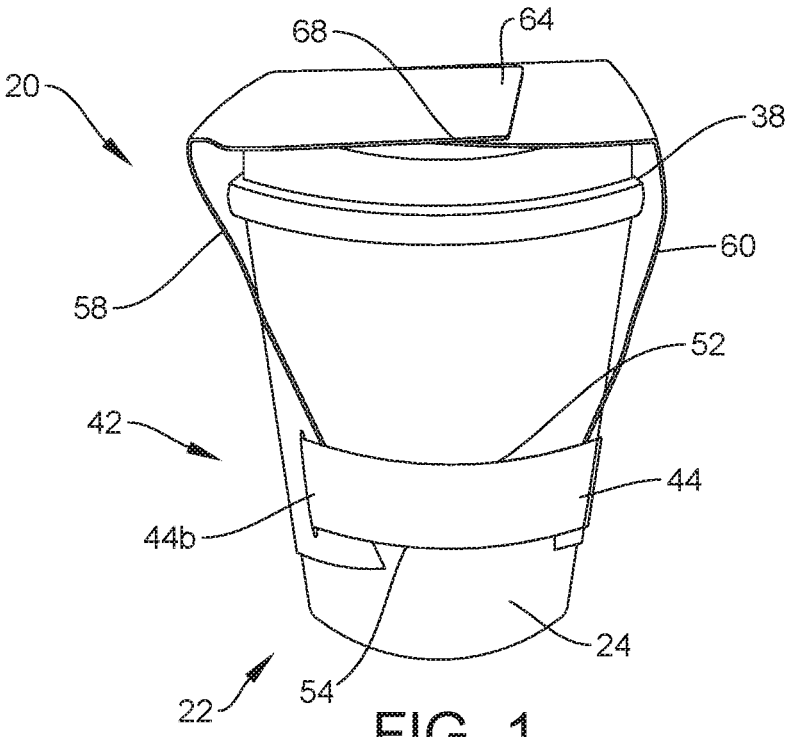
FIG. 1 is a perspective view of one embodiment of a beverage system, in accordance with the principles of the present disclosure.

Arms 58, 60 are movable between an unsecured orientation in which end 68 is spaced apart from lid 38 and end 64 is spaced apart from arm 60, as shown in FIG. 7, and a secured orientation in which end 68 is coupled to lid 38 and end 64 is coupled to end 68, as shown in FIG. 1, to prevent lid 38 from being removed from cup 22. That is, as arms 58, 60 move from the unsecured orientation to the secured orientation, collar 44 translates relative to cup 22 in the direction shown by arrow C in FIG. 6 until surface 44*a* of collar 44 directly engages surface 24*b* of wall 24 to fix collar 44 relative to wall 24 at a position between rim 32 and wall 30. End 68 is then coupled to lid 38 with collar 44 fixed relative to wall 24 at the position between rim 32 and wall 30. End 64 is then coupled with end 68 with collar 44 fixed relative to wall 24 at the position between rim 32 and wall 30. When end 64 is coupled with end 68, collar 44 is prevented from translating relative to cup 22 in the direction shown by arrow B in FIG. 6 or the direction shown by arrow C in FIG. 6. This fixes lid 38 between arms 60, 62 and cup 22 such that lid 38 is prevented from being dislodged from cup 22 to prevent any liquid in cavity 34 from unintentionally spilling out of cup 22. In some embodiments, arm 60 completely covers aperture 40 when end 68 is coupled to lid 38 to prevent any liquid in cavity 34 from exiting cavity 34 through opening 36 and aperture 40. In some embodiments, end 68 is coupled to lid 38 such that there are no gaps or recesses between surface 60*a* of arm 60 and surface 38*a* of lid 38. In some embodiments, at least a portion of end 68 extends parallel to lid 38 and/or surface 38*a* when end 68 is coupled to lid 38 and at least a portion of end 64 extends parallel to lid 38 and/or surface 38*a* when end 64 is coupled with end 68. In some embodiments, arm 60 forms a seal with lid 38 that prevents any liquid in cavity 34 from exiting cavity 34 through opening 36 and aperture 40. In some embodiments, end 68 may be connected to end 64 by threads, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts.

Figure 8:
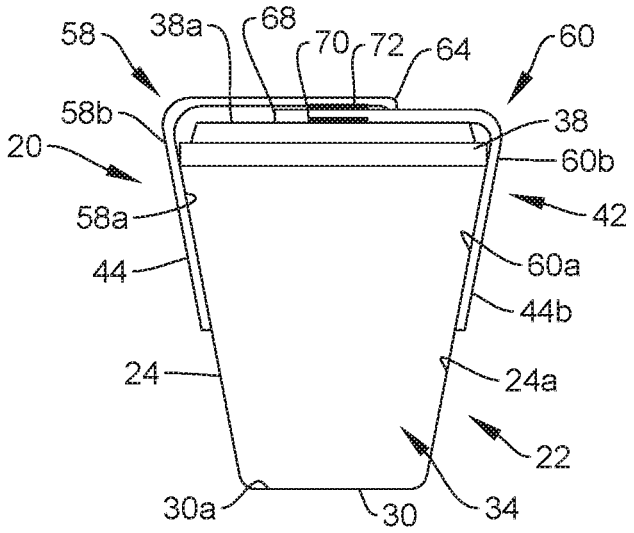
FIG. 8 is a side, cross-section view of one embodiment of components of the beverage system shown in FIG. 1, in accordance with the principles of the present disclosure.

In one embodiment, shown in FIG. 8, an adhesive 70 is positioned between an outer surface 38*a* of lid 38 and surface 60*a* of arm 60 to secure arm 60 to lid 38. In some embodiments, adhesive 70 is fixed to lid 38 before arm 60 is coupled to lid 38. In such embodiments, a strip of plastic, for example, may be applied over adhesive 70. The strip is removed from adhesive 70 and then arm 60 is coupled to adhesive 70. In some embodiments, adhesive 70 is fixed to arm 60 before arm 60 is coupled to lid 38. In such embodiments, a strip of plastic, for example, may be applied over adhesive 70. The strip is removed from adhesive 70 and then adhesive 70 is coupled to lid 38. In some embodiments, surface 38*a* of lid 38 and surface 60*a* of arm 60 may be roughened and/or textured to facilitate gripping with adhesive 70. In some embodiments, adhesive 70 is selected from the group consisting of (meth)acrylates (e.g., isooctyl acrylate/acrylic acid co-polymers and tackified acrylate co-polymers), natural or synthetic rubber resins (e.g., nitrile rubbers, for example, acrylonitile/butadiene), silicone-based adhesives (e.g., polysiloxanes), polyolefins, polyesters, polyamides, block copolymer-based adhesives, polyurethanes, and mixtures thereof.

In one embodiment, an adhesive 72 is positioned between surface 58*a* of arm 58 and surface 60*b* of arm 60, as shown in FIG. 8, to secure end 64 to end 68 when end 68 is coupled to lid 38. In some embodiments, adhesive 80 is fixed to arm 58 before arm 58 is coupled to arm 60. In such embodiments, a strip of plastic, for example, may be applied over adhesive 80. The strip is removed from adhesive 80 and then arm 60 is coupled to adhesive 70. In some embodiments, adhesive 80 is fixed to arm 60 before arm 58 is coupled to arm 60. In such embodiments, a strip of plastic, for example, may be applied over adhesive 80. The strip is removed from adhesive 80 and then adhesive 80 is coupled to arm 58. In some embodiments, surface 58*a* of arm 58 and surface 60*a* of arm 60 may be roughened and/or textured to facilitate gripping with adhesive 80. In some embodiments, adhesive 80 is selected from the group consisting of (meth)acrylates (e.g., isooctyl acrylate/acrylic acid co-polymers and tackified acrylate co-polymers), natural or synthetic rubber resins (e.g., nitrile rubbers, for example, acrylonitile/butadiene), silicone-based adhesives (e.g., polysiloxanes), polyolefins, polyesters, polyamides, block copolymer-based adhesives, polyurethanes, and mixtures thereof.

Figure 9:
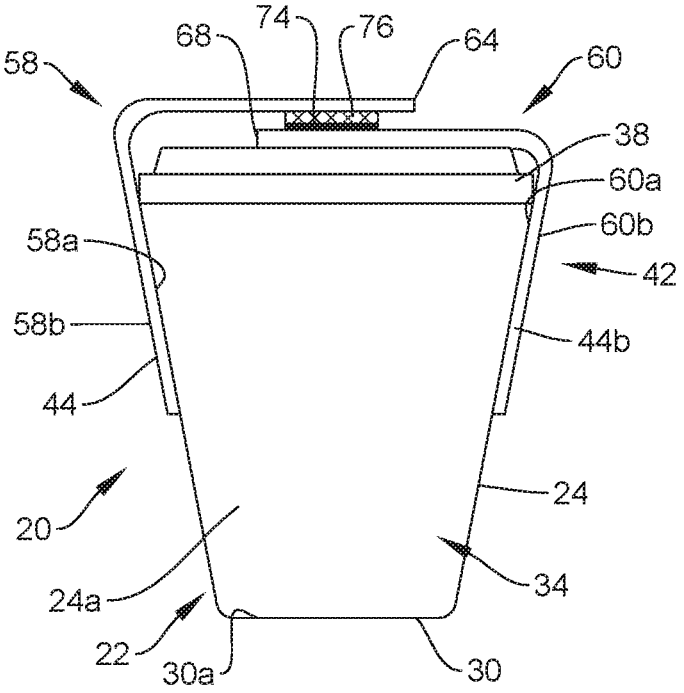
FIG. 9 is a side, cross-section view of one embodiment of components of the beverage system shown in FIG. 1, in accordance with the principles of the present disclosure.

In one embodiment, shown in FIG. 9, end 68 of arm 60 includes a mating element 74 and end 64 of arm 58 includes a mating element 76 that is configured to engage mating element 74 to fix end 64 relative to end 68. In some embodiments, mating element 74 is fixed to surface 60*b* of arm 60 and mating element 76 is fixed to surface 58*a* of arm 58. In some embodiments, mating element 74 is a portion of a hook and loop fastener (e.g., Velcro) that includes hooks and mating element 76 is a portion of the hook and loop fastener that includes loops. In some embodiments, mating element 74 is a portion of a hook and loop fastener that includes loops and mating element 76 is a portion of the hook and loop fastener that includes hooks.

Figure 10:
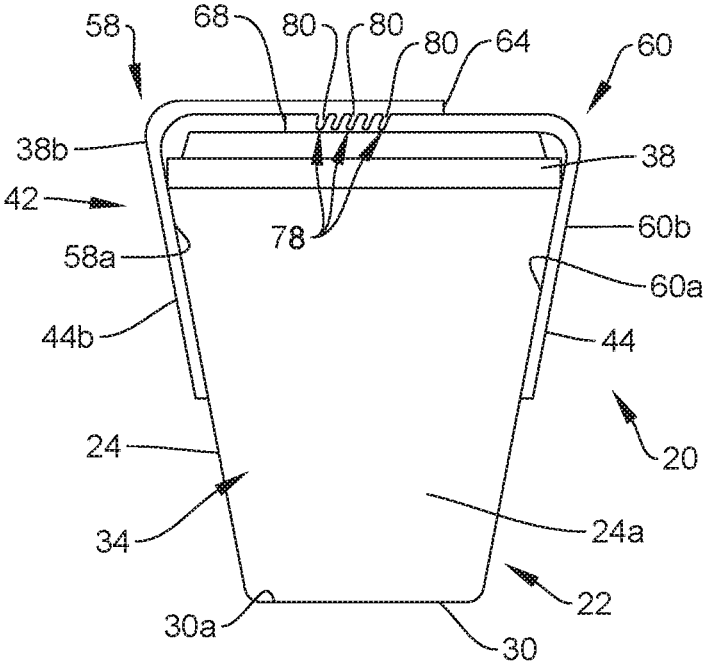
FIG. 10 is a side, cross-section view of one embodiment of components of the beverage system shown in FIG. 1, in accordance with the principles of the present disclosure.

In one embodiment, shown in FIG. 10, end 68 of arm 60 includes one or a plurality of holes 78 and end 64 of arm 58 includes one or a plurality of protrusions 80. Protrusions 80 are each configured for disposal in one of holes 78 to fix end 64 relative to end 68. In some embodiments, protrusions 80 extend outwardly from surface 68*a*. In some embodiments, protrusions 80 are positioned at an angle, such as, for example, an acute angle relative to surface 68*a*. In some embodiments, protrusions 80 include sharp tips configured to penetrate arm 60. In some embodiments, holes 78 extend through surface 60*b* without extending through surface 60*a*. In some embodiments, holes 78 are preformed in arm 60, during a manufacturing process, for example, such that holes 78 are present before arm 58 engages arm 60. In some embodiments, holes 78 are formed by pressing protrusions 80 into surface 60*b*.

Figure 11:
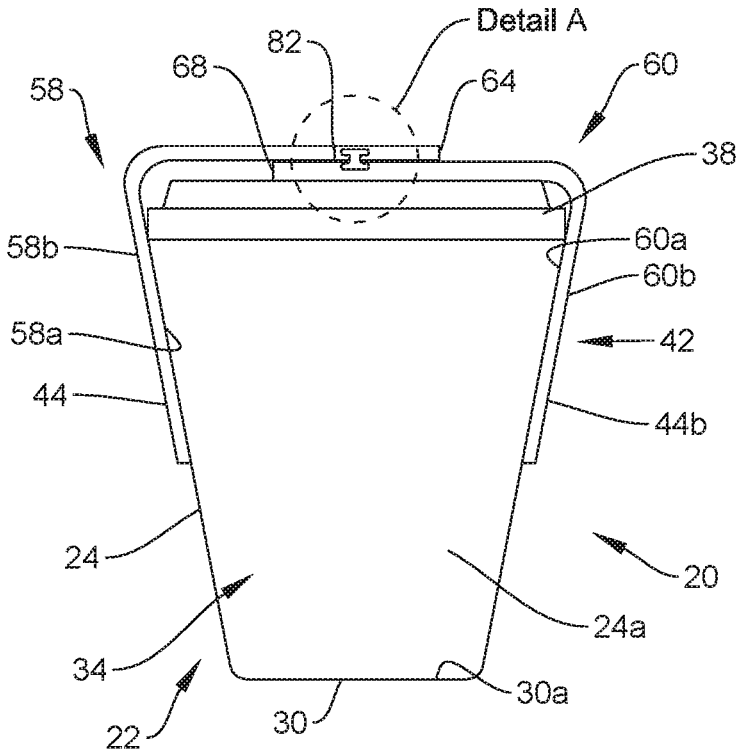
FIG. 11 is a side, cross-section view of one embodiment of components of the beverage system shown in FIG. 1, in accordance with the principles of the present disclosure.
Figure 12:
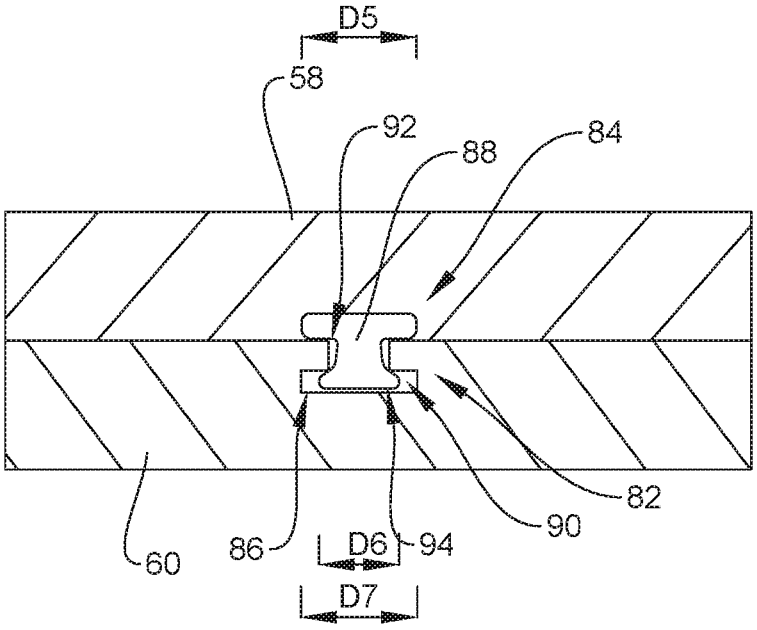
FIG. 12 is an enlarged view of components of the beverage system shown in FIG. 11 at detail A.

In one embodiment, shown in FIGS. 11 and 12, end 68 is fixed to end 64 via a fastener, such as, for example, a snap fastener 82. End 64 includes a portion 84 of fastener 82 and end 68 includes a portion 86 that is configured to receive portion 84 to fix portion 84 relative to portion 86. In particular, portion 84 includes an extension 88 having a maximum diameter D5 and portion 86 includes a recess 90 including a section 92 having a maximum diameter D6 and a section 94 having a maximum diameter D7. Diameter D5 is greater than diameter D6 and less than diameter D7. As such, extension 88 is configured to be inserted into recess 90 by pushing extension 88 through section 92 such that a least a portion of extension 88 is positioned in section 94. Because diameter D5 is greater than diameter D6, extension 88 is prevented from being removed from section 94 without applying a force to extension 88 to move extension through section 92.

Figure 13:
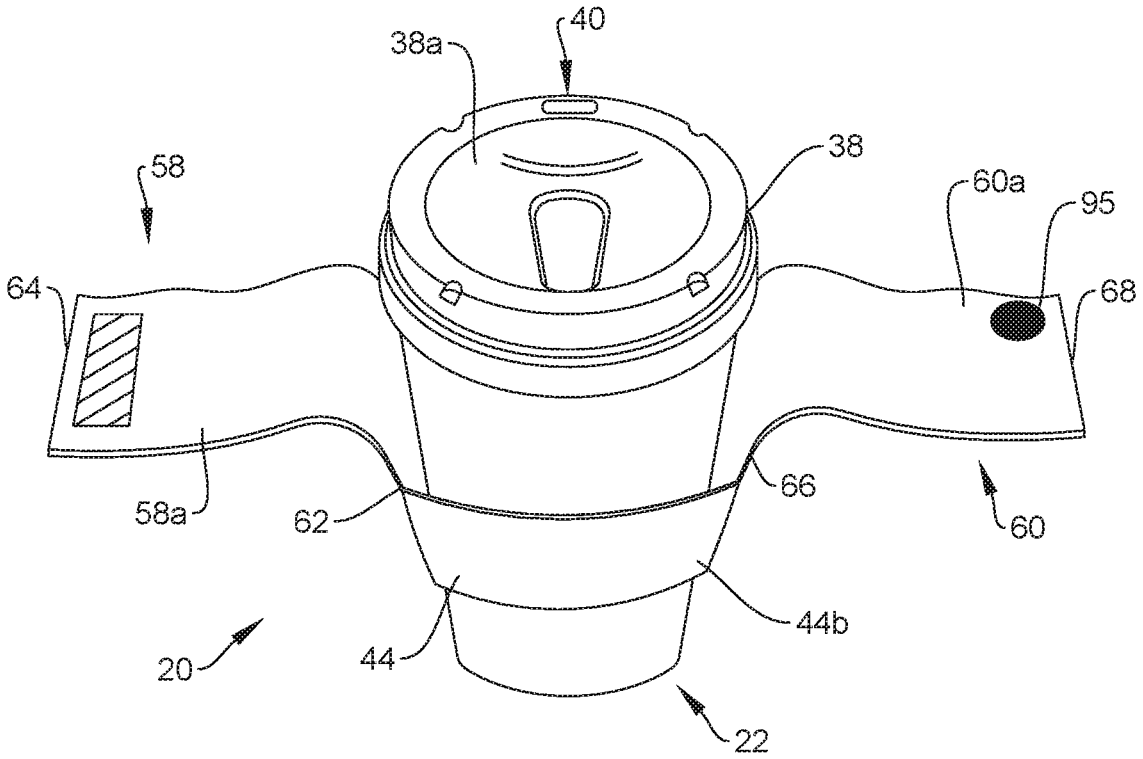
FIG. 13 is a perspective view of one embodiment of components of the beverage system shown in FIG. 1, in accordance with the principles of the present disclosure.
Figure 14:
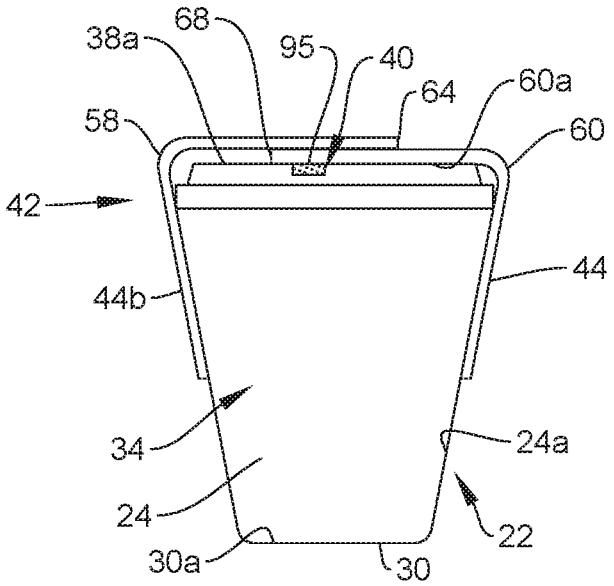
FIG. 14 is a side, cross-section view of one embodiment of components of the beverage system shown in FIG. 13.

In one embodiment, shown in FIGS. 13 and 14, end 68 includes a tab 95 that extends outwardly from surface 60*a*. Tab 95 is configured for disposal in opening 40 to prevent liquid from moving through opening 40. For example, tab 95 may be made from an elastomeric and/or deformable material, such as, for example, silicon or rubber, that acts as a plug to fill opening 40 such that tab 95 prevents liquid from moving through opening 40. Tab 95 is positioned such that tab 95 is positioned within opening 40 when surface 60*a* is coupled to surface 38*a* of lid 38. In some embodiments, all or a portion of arm 58 and/or arm 58 are made from the elastomeric and/or deformable material. In some embodiments, tab 95 has a shape that matches the shape of opening 40. In some embodiments, tab 95 has a maximum diameter that is greater than a maximum diameter of opening 40 such that tab 95 completely fills opening 40 when tab 95 is positioned in opening 40.

In operation and use, end 24 of cup 22 is inserted into orifice 56 by translating cup 22 relative to collar 44 in the direction shown by arrow B in FIG. 6 through end 52, as shown in FIG. 6. Cup 22 is then translated relative to collar 44 in the direction shown by arrow C in FIG. 6 such that surface 44*a* directly engages surface 24*b* of wall 24, as shown in FIG. 7 to fix collar 44 relative to wall 24. End 68 of arm 60 is moved relative to collar 44, lid 38 and cup 22 from an orientation in which end 68 is spaced apart from lid 38, as shown in FIG. 7, to an orientation in which end 68 is coupled to lid 38 either directly, as shown in FIGS. 1 and 2, or via an adhesive, such as, for example, adhesive 70, as shown in FIG. 8.

End 64 of arm 58 is moved relative to collar 44, lid 38 and cup 22 from an orientation in which end 64 is spaced apart from arm 60, as shown in FIG. 7, to an orientation in which end 64 is coupled to end 68 either directly, as shown in FIGS. 1 and 2; via an adhesive, such as, for example, adhesive 80, as shown in FIG. 8; via mating elements, such as, for example, mating elements 74, 76, as shown in FIG. 9; via protrusions and holes, such as, for example, protrusions 80 and holes 78, as shown in FIG. 10; or via a snap fastener, such as, for example, snap fastener 84, as shown in FIGS. 11 and 12. The consumer is then able to transport system 20 to a desired location without risk that a liquid in cavity 34 will spill from cavity 34 either through opening 36 or aperture 40.

When a consumer desires to consume the liquid in cavity 34, he or she can remove arms 58, 60 from lid 38 by decoupling end 64 of arm 58 from end 68 of arm 60 and then decoupling end 68 from lid 38. Once end 68 is decoupled from lid 38, end 68 no longer covers aperture 40 such that the consumer can consume the liquid in cavity 34 by tilting cup 22 such that the liquid in cavity 34 moves through opening 36 an aperture 40 and into the consumer's mouth.

Figure 15:
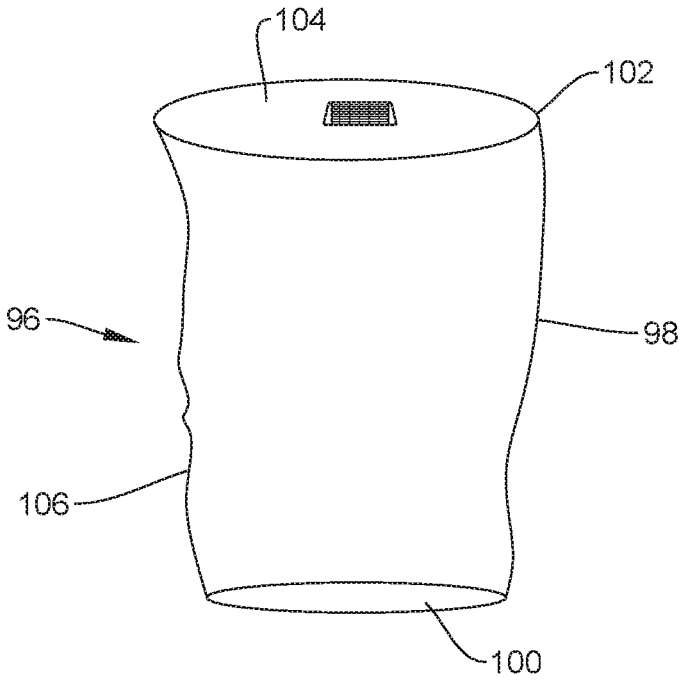
FIG. 15 is a perspective view of one embodiment of a beverage system, in accordance with the principles of the present disclosure.
Figure 16:
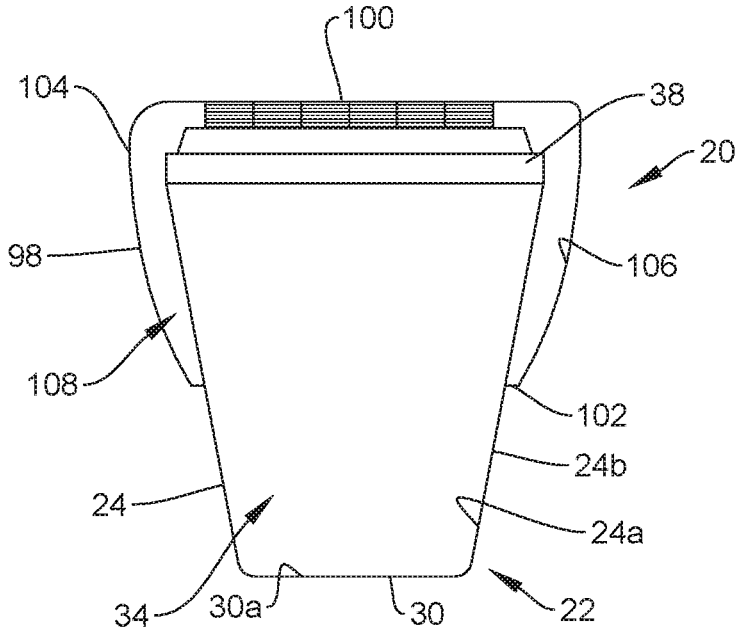
FIG. 16 is a perspective view of components of the beverage system shown in FIG. 15.

In one embodiment, shown in FIGS. 15 and 16, system 20 includes a cap 96 in place of sleeve 42. Cap 96 comprises a body 98 including an end surface 100 and a peripheral edge 102 opposite end surface 100. In some embodiments, end surface 100 is free of any openings. In some embodiments, all or a portion of end surface 100 comprises an adhesive material. In some embodiments, all or a portion of peripheral edge 102 comprises an elastic material or an adhesive material designed to form tightly with the outside surface of the cup. Body 98 includes an inner surface 104 and an opposite outer surface 106. End surface 100 is configured to be coupled to lid 38, as shown in FIG. 16. Peripheral edge 102 is then folded over lid 38 and cup 22 such that peripheral edge 102 directly engages surface 24*b* of wall 24 and surface 106 defines a cavity 108 having lid 38 and a portion of cup 22 enclosed therein. As such, any liquid in cup 22 that spills and/or leaks through lid 38 will be contained within cavity 108. In some embodiments, body 98 may be preformed such that cavity 108 will have a selected shape when peripheral edge 102 is folded over lid 38 and cup 22 such that peripheral edge 102 directly engages surface 24*b* of wall 24. In some embodiments, the shape of cavity 108 matches a shape of cup 22. In some embodiments, cavity 108 may have various shapes, such as, for example, conical, square, rectangular, polygonal, irregular, uniform, non-uniform, variable, tubular and/or tapered. In some embodiments sleeve 42 is disposable. In some embodiments sleeve 42 is made from a cleanable material and the sleeve is reusable.

Figure 16A:
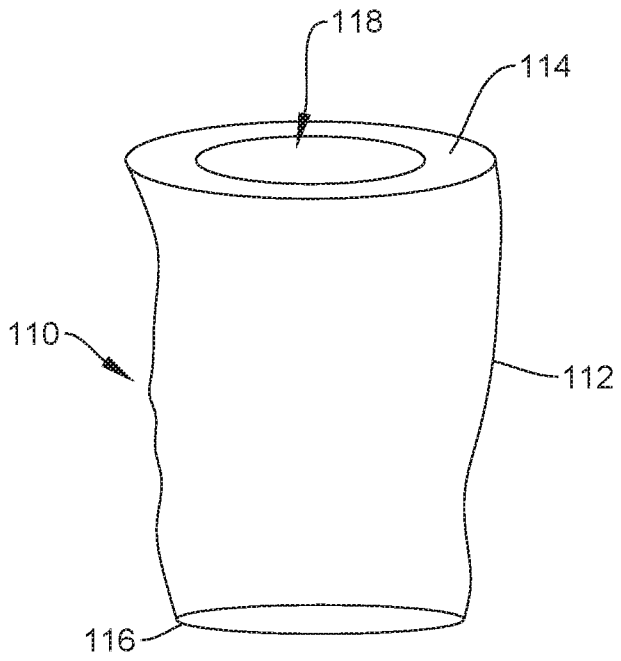
FIG. 16A is a perspective view of one embodiment of a component a beverage system shown in FIG. 16B.
Figure 16B:
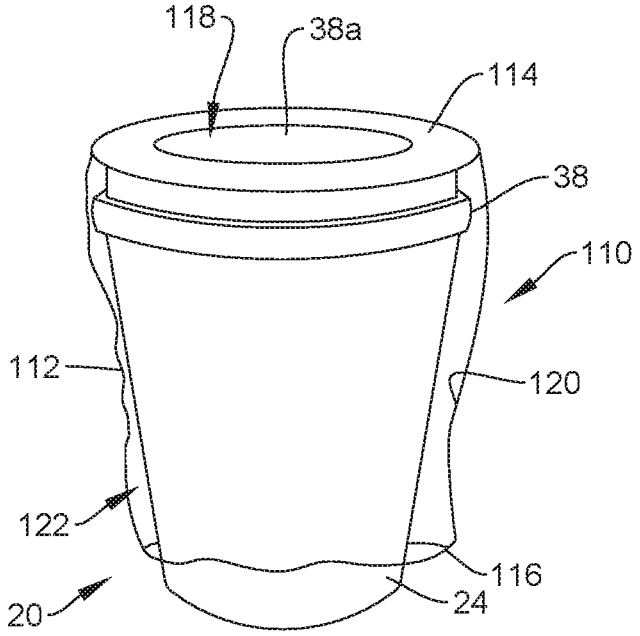
FIG. 16B is a perspective view, in part phantom, of components of a beverage system, in accordance with the principles of the present disclosure.
Figure 16C:
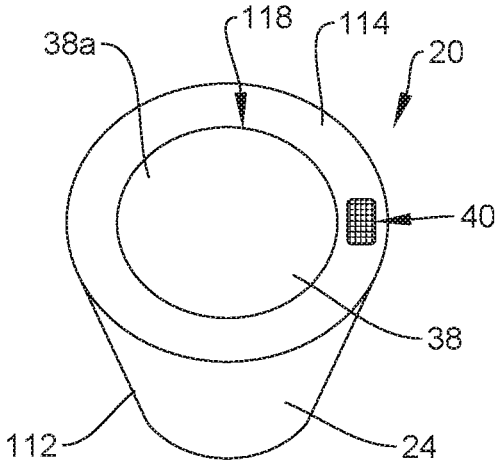
FIG. 16C is a perspective view, in part phantom, of components of the beverage system shown in FIG. 16B.

In one embodiment, shown in FIGS. 16A-16C, system 20 includes a cap 110 that is similar to cap 96. Cap 110 comprises a body 112 including an end surface 114 and a peripheral edge 116 opposite end surface 114. In some embodiments, all or a portion of end surface 114 comprises an adhesive material. In some embodiments, all or a portion of peripheral edge 116 comprises an elastic material. In some embodiments, end surface 114 defines an aperture 118 that extends through a thickness of end surface 114. Aperture 118 allows end surface 114 to cover aperture 40 of lid 38 without covering at least a portion of surface 38*a*, as shown in FIGS. 16B and 16C. Body 112 includes an inner surface 120 that defines a cavity 122 configured for disposal of a portion of cup 22 and a portion of lid 38. End surface 114 is configured to be coupled to lid 38 such that a portion of surface 38*a* is visible through aperture 118, as shown in FIGS. 16B and 16C. Because aperture 40 is covered by end surface 114, any liquid in cup 22 that spills and/or leaks through lid 38 will be contained within cavity 122. In some embodiments, body 112 may be performed such that cavity 122 will have a selected shape. In some embodiments, the shape of cavity 122 matches a shape of cup 22. In some embodiments, cavity 122 and/or aperture 118 may have various shapes, such as, for example, conical, square, rectangular, polygonal, irregular, uniform, non-uniform, variable, tubular and/or tapered.

Figure 17:
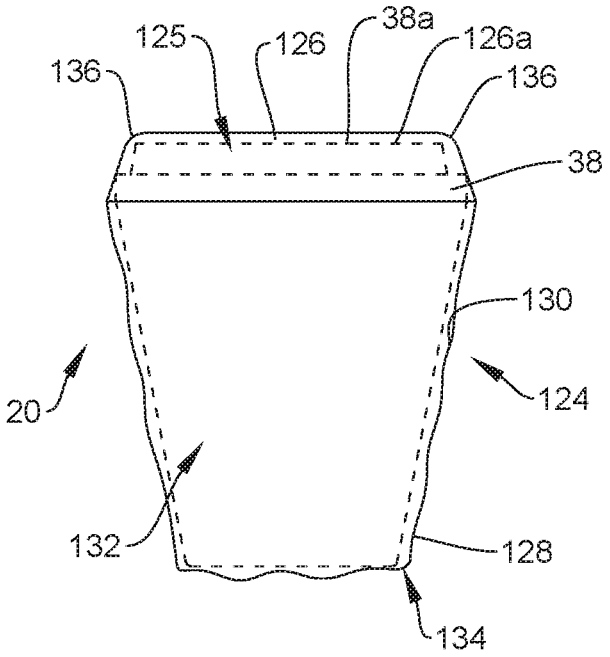
FIG. 17 is a perspective, cross-sectional view of one embodiment of a beverage system, in accordance with the principles of the present disclosure.

In one embodiment, shown in FIG. 17, system 20 includes a cap 124 that is similar to cap 96 and cap 110. Cap 124 is permanently coupled to lid 38 by adhesive, as discussed herein. Cap 124 includes a closed first end 126 and an open second end 128. An inner surface 130 of cap 124 defines a cavity 132 configured for disposal of a portion of lid 38 and a portion of cup 22. An inner surface 126*a* of end 126 defines a cavity 125 that encloses aperture 40 of lid 38. In some embodiments, attachment points 136 are positioned radially outside of aperture 40 such that aperture 40 is positioned between at least two attachment points 136. This allows any liquid in cup 22 that spills from cup 22 through aperture 40 of lid 38 to be contained within cavity 125. End 128 defines an opening 134 that is in communication with cavity 132. In some embodiments, end 126 is coupled to lid 38 at one or a plurality of attachment points 136 by an adhesive, for example. Cavity 132 is spaced apart from cavity 125 by attachment points 136. That is, attachment points 136 form a seal between cavity 132 and cavity 125 such that liquid in cavity 125 is prevented from moving into cavity 132 and liquid in cavity 132 is prevented from moving into cavity 125. In use, a consumer inserts end 28 of wall 24 through opening 134 and translates cup 22 relative to cap 124 to couple lid 38 to cup 22 such that lid 38 is secured to rim 32. Because attachment points 136 form a seal between cavity 132 and cavity 125, any liquid in cup 22 that is spilled from cup 22 through aperture 40 of lid 38 is contained within cavity 125. To consume the liquid in cup 22, the consumer can insert a straw, for example, through end 126 and lid 38 such that the straw is positioned in cavity 34. In some embodiments, the straw is inserted through end 126 and aperture 40 of lid 38 to position the straw in cavity 34.

Figure 18A:
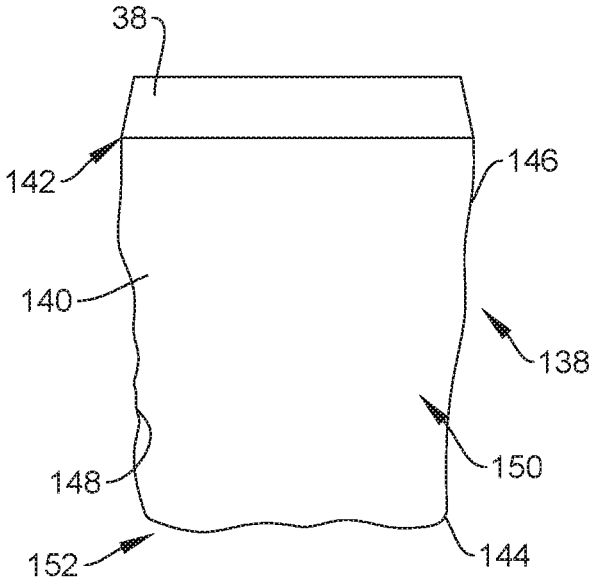
FIG. 18A is a perspective, cross-sectional view of a component of the beverage system shown in FIG. 18B.
Figure 18B:
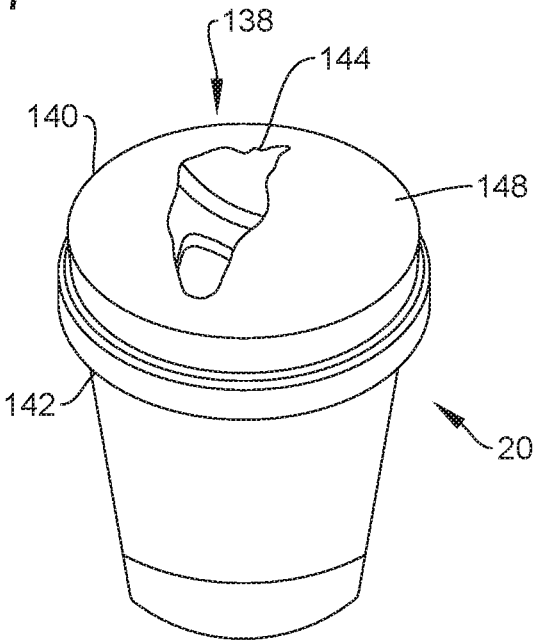
FIG. 18B is a perspective view of one embodiment of a beverage system, in accordance with the principles of the present disclosure.

In one embodiment, shown in FIGS. 18A and 18B, system 20 includes a cap 138 that is similar to cap 96, cap 110 and cap 124. Cap 138 is permanently coupled to lid 38 by adhesive, as discussed herein. Cap 138 includes a body 140 having an end 142 and an opposite end 144. End 142 is permanently coupled to lid 38 by adhesive, for example. In some embodiments, end 142 is coupled to lid 38 such that end 142 forms a watertight seal with lid 38. Body 140 includes a surface 146 and an opposite surface 148 that defines a cavity 150. End 28 of wall 24 is inserted through an opening 152 defined by end 144 such that a portion of cup 22 is positioned within cavity 150. Cup 22 is then translated relative to cap 138 until lid 38 is coupled to cup 22 such that lid 38 is secured to rim 32. End 144 is then folded over lid 38 such that surface 146 directly engages surface 38*a* and body 140 covers aperture 40 of lid 38.

In some embodiments, an adhesive, for example, is applied to surface 146 and/or surface 38*a* to facilitate engagement between surface 146 and surface 38*a*. In some embodiments, end 144 is bunched up about itself when surface 146 directly engages surface 38*a* and body 140 covers aperture 40 of lid 38, as shown in FIG. 18B. In such embodiments, all or a portion of body 140 may be made from a crimpable material that allows end 144 to remain bunched up. In various embodiments, the crimpable material includes one or more of polyvinyl chloride, polyvinylidene chloride, low density polyethylene, linear low density polyethylene, polyisobutene, poly[ethylene-vinylacetate] copolymer and lightweight aluminum foil. To consume the liquid in cup 22, the consumer can insert a straw, for example, through end 144 and lid 38 such that the straw is positioned in cavity 34. In some embodiments, the straw is inserted through end 144 and aperture 40 of lid 38 to position the straw in cavity 34.

Figure 19:
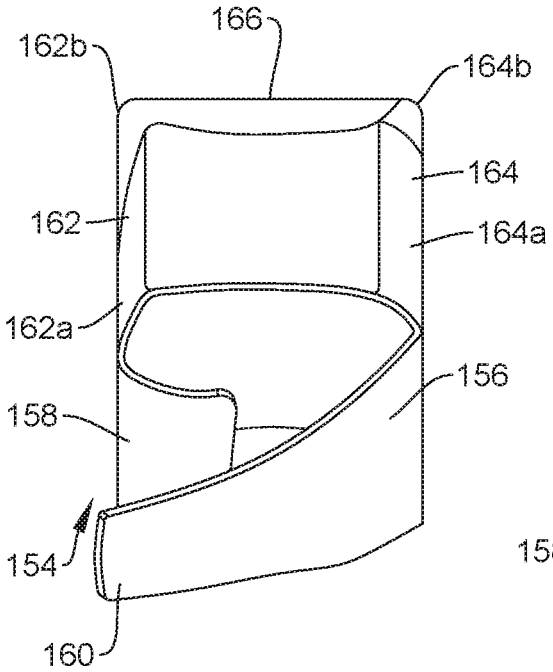
FIG. 19 is a perspective view of one embodiment of a component a beverage system shown in FIG. 20.
Figure 19A:
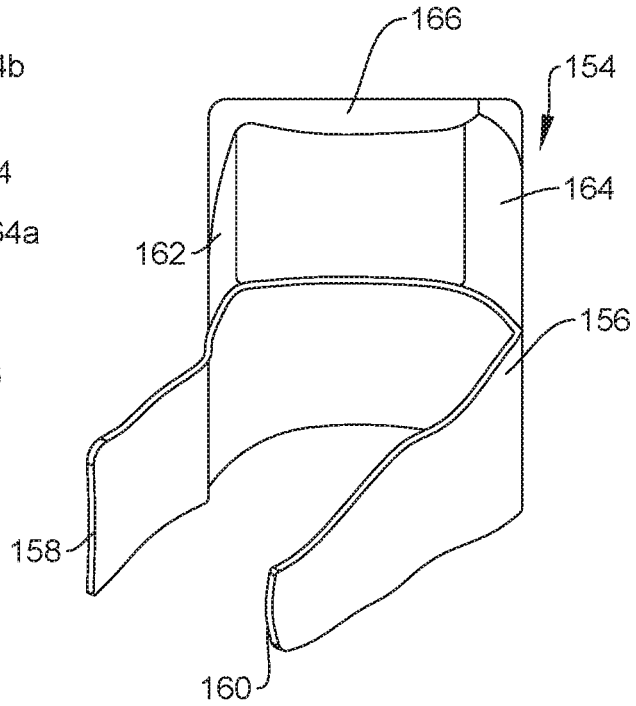
FIG. 19A is a perspective view of the component shown in FIG. 19.
Figure 20:
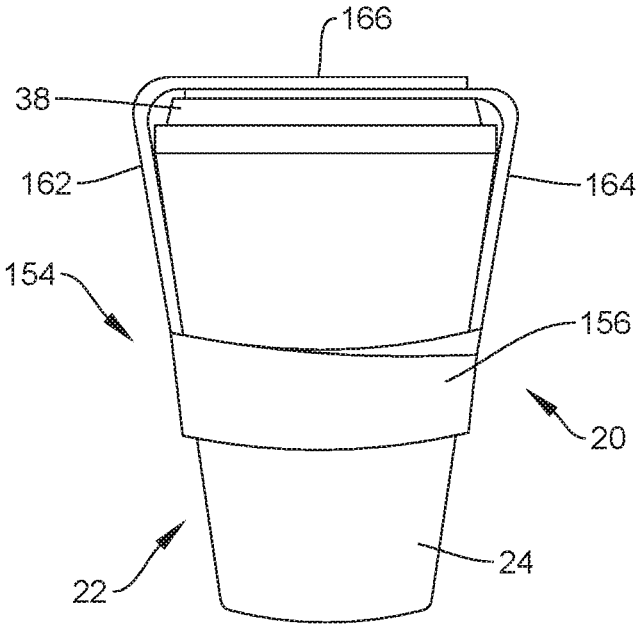
FIG. 20 is a perspective view of components of a beverage system, in accordance with the principles of the present disclosure.

In one embodiment, shown in FIGS. 19-20, system 20 includes a sleeve 154 that is similar to sleeve 42. Sleeve 154 includes a collar 156 that is configured to surround a portion of wall 24. Collar 156 comprises a first end 158 that is configured to be releasably engaged with a second end 160 of collar 156. Collar 156 is movable between a first orientation in which end 158 is coupled to end 160, as shown in FIG. 19, and a second orientation in which end 158 is spaced apart from end 160, as shown in FIG. 19A. In some embodiments, end 158 may be coupled to end 160 via Velcro, snaps, buttons, hooks, mutual grooves, screws, adhesive, nails, barbs, raised elements, spikes, clips, snaps, friction fittings, compressive fittings, expanding rivets, staples, fixation plates, key/keyslot, tongue in groove, dovetail, magnetic connection and/or posts. Sleeve 154 comprises an arm 162 extending from end 158 and an arm 164 extending from end 160. Arm 162 includes an end 162*a* that is coupled to collar 156 and an opposite end 162*b*. Arm 164 includes an end 164*a* that is coupled to collar 156 and an opposite end 164*b*. Ends 162*b*, 164*b* are connected to one another by a cross member 166 configured to engage lid 38 to prevent lid 38 from becoming dislodged from cup 22. In some embodiments, cross member 166 is configured to cover aperture 40 when cross member 166 engages lid 38 to prevent any liquid in cup 22 from spilling from cup 22 through aperture 40.

In operation and use, end 24 of cup 22 is inserted into collar 156 with collar 156 in the second orientation such that end 158 is spaced apart from end 160, as shown in FIG. 19A. Cup 22 is translated relative to collar 156 such cross member 166 directly engages surface 38*a* of lid 38, as shown in FIG. 20. Collar 156 is then moved from the second orientation to the first orientation such that end 158 is coupled to end 160 to fix sleeve 154 relative to cup 22 and lid 38. When a consumer desires to consume the liquid in cavity 34, he or she can move collar 156 from the first orientation to the second orientation. Cup 22 is translated relative to collar 156 such cross member 166 is spaced apart from surface 38*a* of lid 38 to expose aperture 40 such that the consumer can consume the liquid in cavity 34 by tilting cup 22 such that the liquid in cavity 34 moves through opening 36 an aperture 40 and into the consumer's mouth.

Figure 21:
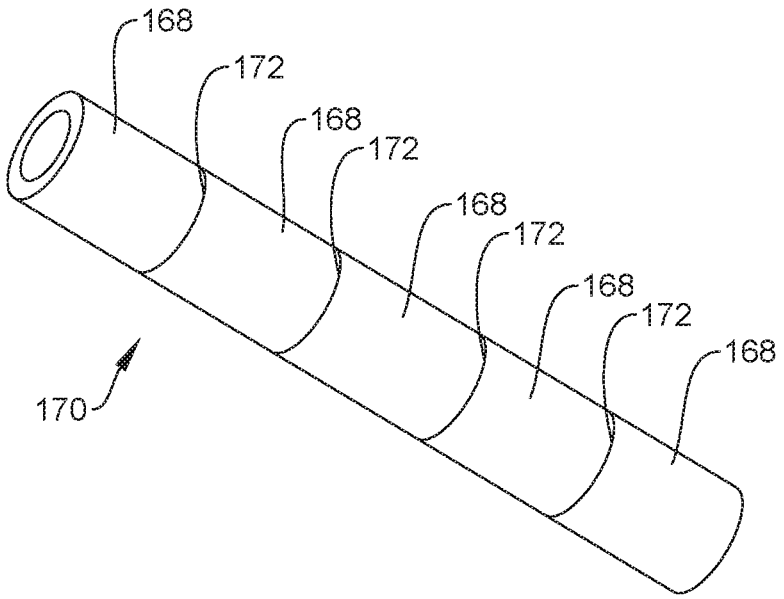
FIG. 21 is a perspective view of one embodiment of a component a beverage system, in accordance with the principles of the present disclosure.

In one embodiment, shown in FIG. 21, system 20 includes one or a plurality of caps 168 that are the same or similar to one of cap 96, cap 110 and/or cap 124 in which caps 168 are coupled to one another to form a strip 170 to facilitate dispensing of caps 168. It is envisioned that strip 170 may be wound about itself to form a roll wherein the roll can be provided by itself or positioned about a roller for dispensing of caps 168. In some embodiments, adjacent caps 168 are joined together by lines of weakness or perforations 172 to permit a single cap 168 to be separated from strip 170 without cutting the same with a scissor or other cutting means.

In some embodiments, the roller is positioned in a dispenser that either hangs from a wall or sits on a counter that the caps can be pulled from and disconnected from the previous cap on the roll to be used. The dispenser can be disposable or refillable, like a cash register tape used to print receipts in a cash register.

In operation and use, the above embodiments when positioned on the cup aid in preventing spills as well as insulating the user's hand from either thermal transfer when used o on a cup containing hot beverages or from getting wet from the sweat that forms on the outside surface of a cup containing a cold beverage. The above embodiments can be made from a washable material so that they are reusable preventing waste. In the alternative, the above embodiments can be made from a disposable, in expensive material configured to protect from heat transfer and/or water transfer to the user's hands while simultaneously protecting against spills.

It will be understood that various modifications may be made to the embodiments disclosed herein. Therefore, the above description should not be construed as limiting, but merely as exemplification of the various embodiments. Those skilled in the art will envision other modifications within the scope and spirit of the claims appended.

What is claimed is:

1. A beverage system comprising:

a cup comprising a frustoconical wall extending from a first end to a second end, the first end being coupled to a bottom wall and the second end defining a rim, inner surfaces of the walls defining a cavity, the rim defining an opening that is in communication with the cavity;

a lid coupled to the rim such that the lid covers at least a portion of the opening; and a sleeve comprising a collar that surrounds a portion of the frustoconical wall, the collar comprising an inner surface that directly engages the frustoconical wall, the sleeve comprising first and second arms, the arms each including an outer surface that directly engages the inner surface, the arms each including a first end coupled to the collar and an opposite second end, the second end of the first arm directly engaging the lid, the second end of the second arm directly engaging the second end of the first arm when the second end of the first arm directly engages the lid to prevent the lid from being removed from the cup.

2. The beverage system recited in claim 1, wherein the first arm has a uniform thickness from the first end of the first arm to the second end of the first arm and the second arm has a uniform thickness from the first end of the second arm to the second end of the second arm.

3. The beverage system recited in claim 1, wherein the arms are free of any preformed fold lines.

4. The beverage system recited in claim 1, further comprising an adhesive between the second end of the second arm and the second end of the first arm to secure the second end of the second arm to the second end of the first arm.

5. The beverage system recited in claim 1, further comprising:

a first adhesive between the second end of the second arm and the second end of the first arm to secure the second end of the second arm to the second end of the first arm; and a second adhesive between the lid and the second end of the first arm to secure the second end of the first arm to the lid.

6. The beverage system recited in claim 1, wherein the second end of the first arm comprises a first mating element and the second end of the second arm comprises a second mating element that engages the first mating element to couple the second end of the second arm to the second end of the first arm.

7. The beverage system recited in claim 6, wherein the mating elements each include a portion of a hook and loop fastener.

8. The beverage system recited in claim 1, wherein the second end of the second arm comprises a protrusion that extends into the second end of the first arm to couple the second end of the second arm to the second end of the first arm.

9. The beverage system recited in claim 1, wherein the sleeve comprises a non-insulated material.

10. The beverage system recited in claim 1, wherein the sleeve comprises a material selected from the group comprising paper and unfoamed plastic.

11. The beverage system recited in claim 1, wherein the sleeve comprises an insulating material.

12. The beverage system recited in claim 1, wherein the collar has a height defined by a distance between a top end of the collar and an opposite bottom end of the collar, the collar being tapered such that the top end has a diameter that is greater than a diameter of the bottom end.

13. The beverage system recited in claim 1, wherein the first arm has a maximum length that is equal to a maximum length of the second arm.

14. The beverage system recited in claim 1, wherein the collar comprises a first end that is permanently joined with a second of the collar to define a loop.

15. A method for prevent a liquid from leaking from a container, the method comprising:

providing the beverage system recited in claim 1, with the beverage system recited in claim 1 in an unassembled state;

coupling the lid to the rim;

positioning the cup in the collar with the second end of the first arm spaced apart from the lid and the second end of the second arm;

translating the collar relative to the cup such that the collar forms a friction fit with the frustoconical wall;

coupling the second end of the first arm to the lid; and coupling the second end of the second arm to the second end of the first arm.

16. A beverage system comprising:

a cup comprising a non-insulated material and a frustoconical wall extending from a first end to a second end, the first end being coupled to a bottom wall and the second end defining a rim, inner surfaces of the walls defining a cavity, the rim defining an opening that is in communication with the cavity;

a lid coupled to the rim such that the lid covers at least a portion of the opening;

a sleeve comprising a collar that surrounds a portion of the frustoconical wall, the collar comprising an inner surface that directly engages the frustoconical wall, the collar comprising a first end that is permanently joined with a second of the collar to define a loop, the collar having a height defined by a distance between a top end of the collar and an opposite bottom end of the collar, the collar being tapered such that the top end has a diameter that is greater than a diameter of the bottom end, the sleeve comprising first and second arms, the arms each including an outer surface that directly engages the inner surface, the first arm having a maximum length that is equal to a maximum length of the second arm, the arms each including a first end coupled to the collar and an opposite second end, the first arm having a uniform thickness from the first end of the first arm to the second end of the first arm, the second arm having a uniform thickness from the first end of the second arm to the second end of the second arm, the second end of the first arm directly engaging the lid, the second end of the second arm directly engaging the second end of the first arm when the second end of the first arm directly engages the lid to prevent the lid from being removed from the cup; and an adhesive between the second end of the second arm and the second end of the first arm to secure the second end of the second arm to the second end of the first arm.

17. A beverage system comprising:

a cup comprising a wall extending from a first end to a second end defining a rim, an inner surface of the wall defining a cavity, the rim defining an opening that is in communication with the cavity;

a lid coupled to the rim such that the lid covers at least a portion of the opening; and a sleeve comprising a collar that surrounds an entire perimeter of the wall, the collar comprising an inner surface that directly engages the wall, the sleeve comprising first and second arms, the arms each including an outer surface that directly engages the inner surface, the arms each including a first end coupled to the collar and an opposite second end, the second end of the first arm directly engaging the lid, the second end of the second arm directly engaging the second end of the first arm when the second end of the first arm directly engages the lid to prevent the lid from being removed from the cup.

18. The beverage system recited in claim 17, further comprising an adhesive between the second end of the second arm and the second end of the first arm to secure the second end of the second arm to the second end of the first arm.

19. The beverage system recited in claim 17, further comprising:

a first adhesive between the second end of the second arm and the second end of the first arm to secure the second end of the second arm to the second end of the first arm; and a second adhesive between the lid and the second end of the first arm to secure the second end of the first arm to the lid.

20. The beverage system recited in claim 1, wherein the collar defines a continuous loop.

* * * * *